US011644224B2

(12) United States Patent
Braun et al.

(10) Patent No.: US 11,644,224 B2
(45) Date of Patent: May 9, 2023

(54) PORTABLE AUTOMATIC REFRIGERANT CHARGING DEVICE AND METHOD

(71) Applicant: Purdue Research Foundation, West Lafayette, IN (US)

(72) Inventors: James Edward Braun, West Lafayette, IN (US); Eckhard Achim Groll, West Lafayette, IN (US); Davide Ziviani, West Lafayette, IN (US); Akash Patil, West Lafayette, IN (US); Changkuan Liang, West Lafayette, IN (US); Orkan Kurtulus, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 125 days.

(21) Appl. No.: 17/095,828

(22) Filed: Nov. 12, 2020

(65) Prior Publication Data

US 2021/0164713 A1 Jun. 3, 2021

Related U.S. Application Data

(60) Provisional application No. 62/942,778, filed on Dec. 3, 2019.

(51) Int. Cl.
*F25B 45/00* (2006.01)

(52) U.S. Cl.
CPC ..... *F25B 45/00* (2013.01); *F25B 2345/003* (2013.01); *F25B 2345/006* (2013.01)

(58) Field of Classification Search
CPC ..... F25B 45/00; F25B 2345/003; F25B 2345/006
See application file for complete search history.

(56) References Cited

U.S. PATENT DOCUMENTS

| | | | | |
|---|---|---|---|---|
| 7,086,237 | B2 | 8/2006 | Arshansky | |
| 9,618,158 | B2 * | 4/2017 | Killeen | F17D 3/00 |
| 10,960,757 | B2 * | 3/2021 | Pourcheresse | B60K 15/04 |
| 2007/0044493 | A1 * | 3/2007 | Kearney | F25B 41/35 236/92 B |

* cited by examiner

*Primary Examiner* — Ana M Vazquez
(74) *Attorney, Agent, or Firm* — Purdue Research Foundation

(57) ABSTRACT

An apparatus for providing an optimized amount of refrigerant to a refrigeration system includes three valves coupled with a fluid coupling, the first valve being coupled between the fluid coupling and an inlet of a refrigerant source, the second valve being coupled between the fluid coupling and an outlet of the refrigerant source, the third valve being coupled between the fluid coupling and the refrigeration system, the fluid coupling having a refrigerant chamber operable to store a volume of refrigerant to selectively provide the volume of refrigerant to the refrigeration system upon operation of the first, second, and third valves.

11 Claims, 5 Drawing Sheets

| Pulse # | Cumulative Mass Injected (grams) into tank | | |
|---|---|---|---|
| | One Pulse | Two Pulses | Three Pulses |
| 1 | 4.2 | 8.7 | 13.2 |
| 2 | 4.3 | 8.8 | 13.2 |
| 3 | 4.3 | 8.7 | 13.3 |
| Mean (grams) | 4.23 | 8.73 | 13.23 |
| Addition (grams) | 4.23 | 4.50 | 4.50 |

FIG. 4

PORTABLE AUTOMATIC REFRIGERANT CHARGING DEVICE AND METHOD

CROSS-REFERENCE TO RELATED APPLICATIONS

The present patent application is related to and claims the priority benefit of U.S. Provisional Patent Application No. 62/942,778, filed Dec. 3, 2019, entitled "Portable Automatic Refrigerant Charging Device and Method," the contents of which are incorporated in their entirety herein by reference.

TECHNICAL FIELD

The present disclosure relates to a novel portable apparatus suitable for providing an optimized amount of refrigerant to a refrigeration system, and to methods of using the novel portable apparatus.

BACKGROUND

This section introduces aspects that may help facilitate a better understanding of the disclosure. Accordingly, these statements are to be read in this light and are not to be understood as admissions about what is or is not prior art.

Refrigerant charge level is essential for the performance of vapor compression equipment. Determining the optimal charge for vapor compression equipment is an important step for manufacturers. To determine the optimal charge, the unit has to run under different charge levels and data are collected to generate a relationship between performance and charge level. Currently, this process includes repeated evacuation and charging of equipment. This means a large amount of time and effort is needed.

Therefore, novel devices that significantly reduces the time required to determine optimal change compared to existing approaches, especially for laboratory settings are still needed.

SUMMARY

The present disclosure relates to a novel portable apparatus suitable for providing an optimized amount of refrigerant to a refrigeration system, and to methods of using the novel portable apparatus.

In one embodiment, the present disclosure provides a portable apparatus suitable for providing an optimized amount of refrigerant to a refrigeration system comprising:

a first solenoid valve with a first inlet and a first outlet;

a second solenoid valve with a second inlet and a second outlet;

a third solenoid valve with a third inlet and a third outlet; and a three-way connector with a first opening, a second opening and a third opening;

wherein:

the first inlet of the first solenoid valve is configured to connect to the first opening of the three-way connector, the first outlet of the first solenoid valve is configured to connect to the refrigerant providing source through a vapor line that is attached to a vapor inlet of the refrigerant providing source, the second inlet of the second solenoid valve is configured to connect to the refrigerant providing source through a liquid line to receive a liquid refrigerant released from a liquid outlet of the refrigerant providing source, the second outlet of the second solenoid valve is configured to connect to the second opening of the three-way connector, the third inlet of the third solenoid valve is configured to connect to the third opening of three-way connector, the third outlet of the third solenoid valve is configured to connect to a refrigeration system to be charged with optimal amount of refrigerant, the space within the three-way connector is configured to be a refrigerant calibrating chamber.

In one embodiment, the present disclosure provides a method of providing an optimal amount a refrigerant to a refrigeration system with the portable apparatus of this disclosure.

BRIEF DESCRIPTION OF THE DRAWINGS

FIG. 4 illustrates results of three sets of experiments regarding cumulative mass injected into a tank.

DETAILED DESCRIPTION

Figure 1:
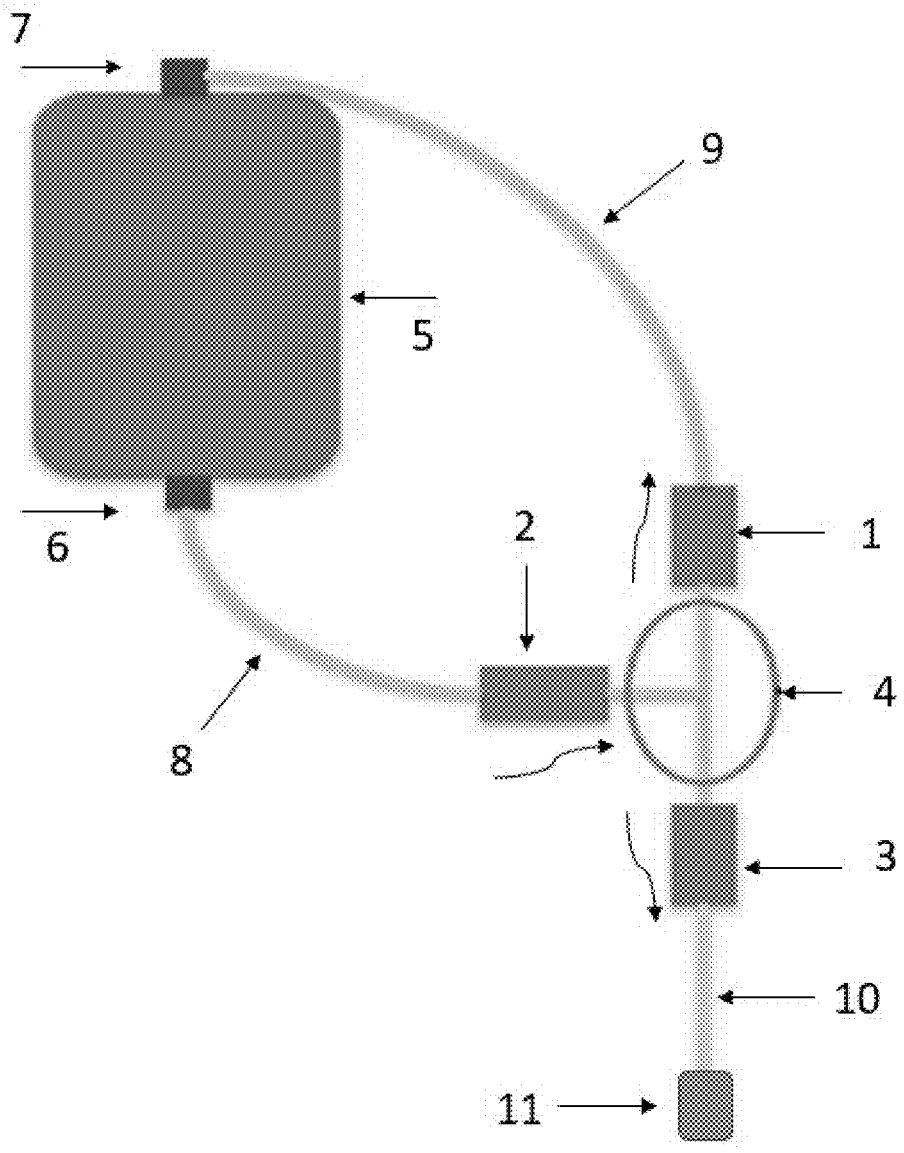
FIG. 1 illustrates a schematic diagram of the experimental setup used for the portable apparatus of this disclosure.

For the purposes of promoting an understanding of the principles of the present disclosure, reference will now be made to embodiments illustrated in drawings, and specific language will be used to describe the same. It will nevertheless be understood that no limitation of the scope of this disclosure is thereby intended.

In the present disclosure the term "about" can allow for a degree of variability in a value or range, for example, within 10%, within 5%, or within 1% of a stated value or of a stated limit of a range.

In the present disclosure the term "substantially" can allow for a degree of variability in a value or range, for example, within 90%, within 95%, or within 99% of a stated value or of a stated limit of a range.

In one embodiment, the present disclosure provides a portable apparatus suitable for providing an optimized amount of refrigerant to a refrigeration system comprising:

a first solenoid valve with a first inlet and a first outlet;

a second solenoid valve with a second inlet and a second outlet;

a third solenoid valve with a third inlet and a third outlet; and a three-way connector with a first opening, a second opening and a third opening;

wherein:

the first inlet of the first solenoid valve is configured to connect to the first opening of the three-way connector, the first outlet of the first solenoid valve is configured to connect to the refrigerant providing source through a vapor line that is attached to a vapor inlet of the refrigerant providing source, the second inlet of the second solenoid valve is configured to connect to the refrigerant providing source through a liquid line to receive a liquid refrigerant released from a liquid outlet of the refrigerant providing source, the second outlet of the second solenoid valve is configured to connect to the second opening of the three-way connector, the third inlet of the third solenoid valve is configured to connect to the third opening of three-way connector, the third outlet of the third solenoid valve is configured to connect to a refrigeration system to be charged with optimal amount of refrigerant, the space within the three-way connector is configured to be a refrigerant calibrating chamber.

In one embodiment regarding the portable apparatus of this disclosure, wherein the space within the three-way connector has a volume of about 0.5 mL to about 10 mL, 0.5 mL to about 5 mL, or 0.5 mL to about 2.5 mL.

In one embodiment regarding the portable apparatus of this disclosure, wherein the three-way connector has a coated internal surface to mitigate trapping of the refrigerant when the refrigerant is to be released to the refrigeration system.

A portable apparatus suitable for providing an optimized amount of refrigerant to a refrigeration system comprising:

refrigerant providing source comprising a liquid outlet and a vapor inlet;

a first solenoid valve with a first inlet and a first outlet;

a second solenoid valve with a second inlet and a second outlet;

a third solenoid valve with a third inlet and a third outlet; and a three-way connector with a first opening, a second opening and a third opening;

wherein:

the first inlet of the first solenoid valve is configured to connect to the first opening of the three-way connector, the first outlet of the first solenoid valve is configured to connect to the refrigerant providing source through a vapor line that is attached to the vapor inlet of the refrigerant providing source, the second inlet of the second solenoid valve is configured to connect to the refrigerant providing source through a liquid line to receive a liquid refrigerant released from the liquid outlet of the refrigerant providing source, the second outlet of the second solenoid valve is configured to connect to the second opening of the three-way connector, the third inlet of the third solenoid valve is configured to connect to the third opening of three-way connector, the third outlet of the third solenoid valve is configured to connect to a refrigeration system to be charged with optimal amount of refrigerant, the space within the three-way connector is configured to be a refrigerant calibrating chamber In one embodiment, the present disclosure provides a method of providing an optimal amount a refrigerant to a refrigeration system comprising:

a) providing a portable apparatus of the present disclosure;

b) providing a refrigerant providing source comprising a liquid refrigerant outlet and a gaseous refrigerant inlet;

c) providing a refrigeration system to be charged;

d) leaving the first solenoid valve and the second solenoid valve open and the third solenoid valve closed;

e) allowing liquid refrigerant to be introduced through the second solenoid valve into the calibrating chamber, and allowing vapor refrigerant to be released through the first solenoid and the vapor line into the refrigerant providing source until the refrigerant calibrating chamber is filled with liquid refrigerant;

f) closing the first solenoid valve and the second solenoid valve, opening the third solenoid valve, and allowing the liquid refrigerant in the calibrating chamber to be released into the refrigeration system to be charged, wherein the liquid refrigerant becomes vapor refrigerant when the liquid refrigerant is suctioned out from the calibrating chamber to the refrigeration system;

repeating steps d)-f) until an optimal amount of refrigerant is achieved in the refrigeration system In one embodiment regarding the method of providing an optimal amount a refrigerant to a refrigeration system, wherein an algorithm is implemented to automatically determine whether the amount of refrigerant in the system is at an optimal level.

DEVICES AND METHODS

For the hardware side of the device, the main goal is to design an apparatus to accurately and consistently charge a certain amount of refrigerant to a refrigeration system. Since this disclosure focus on charge testing for refrigerators, the design of the device has to consider the small amount of refrigerant inventory of a typical refrigerator. With normally less than 200 grams of refrigerant inside the system, steps for the charging curve has to be around 5 grams or less to generate a meaningful relationship between charge and performance. Due to the small amount of refrigerant for each addition, a weighing scale measuring the amount of refrigerant taken from the tank is not possible to reach the required level of accuracy.

The approach for this disclosure is to use a combination of three solenoid devices to create a calibrated volume, like shown in FIG. 1. The system comprises solenoid valve 1, solenoid valve 2, solenoid valve 3, three-way connector 4, refrigerant tank 5 comprising a liquid refrigerant outlet 6 and a vapor refrigerant return inlet 7, Refrigerant tank 5 will be connected to the device via a liquid refrigerant line 8 and a vapor refrigerant return line 9, a refrigerant line 10 connecting to a refrigeration system 11. Solenoid 2 is connected to the liquid side of the refrigerant tank while a vapor return line is connected to solenoid 1. Once solenoid 1 and 2 are both open and solenoid 3 is closed, liquid refrigerant will flow into the calibrated volume formed by space within the three-way connector and the vapor will escape through solenoid 1 and return to tank 5 through line 9. Once the calibrated volume is filled, the solenoid 1 and 2 will close then solenoid 3 will open to suction. Liquid refrigerant contained in the calibrated volume will be charged into suction. Since during operation the suction pressure of a normal refrigerator will be much lower than the saturation pressure of liquid refrigerant at room temperature, all the liquid refrigerant will be vaporized and charged into system with only vapor refrigerant of equal volume left in the calibrated volume. This sequence of solenoid operation is called a pulse for this device. With the calibrated volume ensuring consistency, each pulse should charge the same amount of refrigerant into the system.

The approach uses a constant calibrated volume to guarantee accuracy and consistency in the charging process. Since weight of the refrigerant is too difficult to accurately measure and control directly, controlling the volume of the refrigerant is the alternative approach selected in this disclosure. While the volume is fixed in this approach, the varying density of the refrigerant is still a challenge. The density of the refrigerant changes with the quality of the refrigerant. Ensuring that the calibrated volume is filled entirely with liquid is imperative to the performance of the device.

To ensure the calibrated volume is filled with liquid, a vapor return line is required. The calibrated volume is around 2 cc thus the diameter of the tubes used are ⅛"

copper tube. For a copper tube of this size, vapor is very likely to be trapped inside the volume and unable to escape therefore impacting the performance of device. If only two solenoids are used to connect the refrigerant tank and the unit, the remaining vapor in the calibrated volume after each pulse will be trapped in the device and prevent liquid to fill out the entire calibrated volume. Using a vapor return line with the geometry shown in FIG. 1, the vapor lock problem can be effectively solved and the consistency of the device can be ensured.

Figure 2:
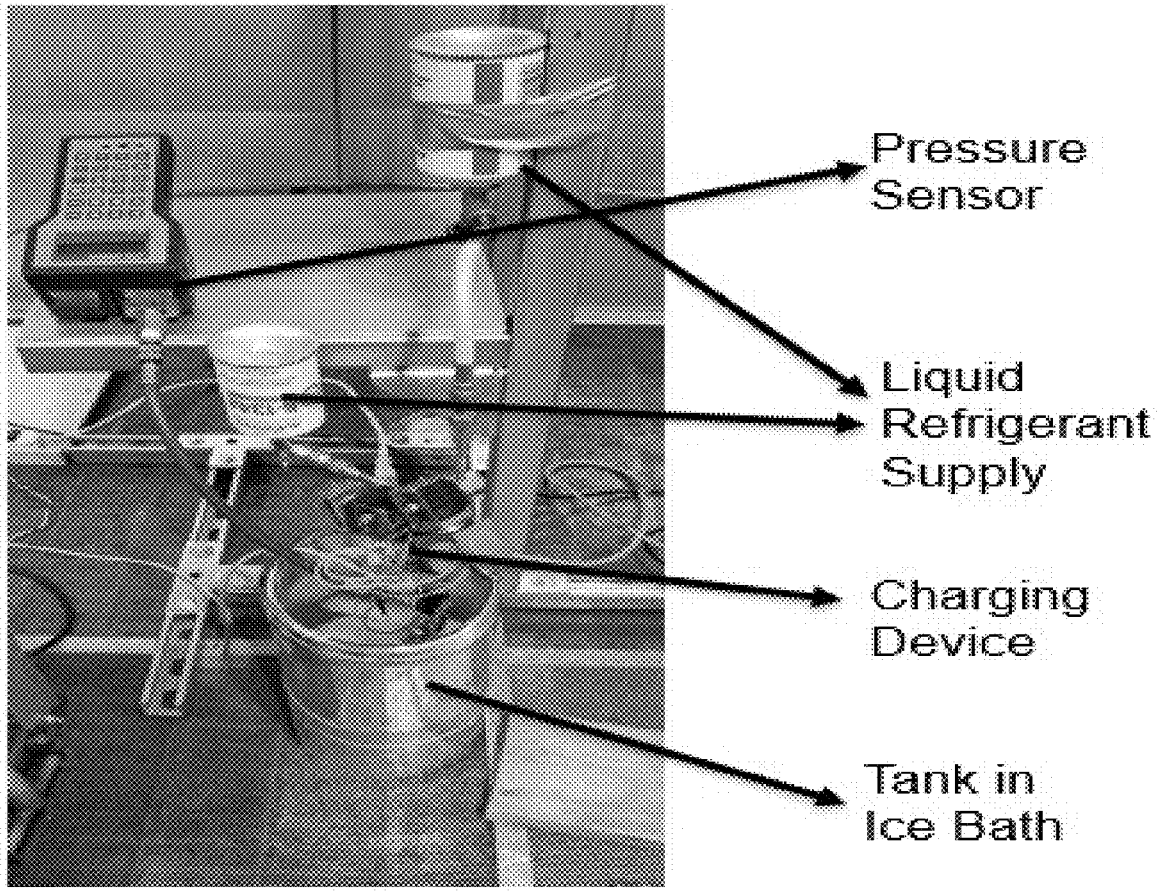
FIG. 2 illustrates an actual volume calibration experimental setup.

To account for the volume in the lines between solenoid 3 and the unit, an experiment is designed to determine and calibrate the actual amount of liquid refrigerant charged into the unit. An evacuated tank is connected to downstream of solenoid 3 and refrigerant will be charged into this tank. The tank is kept in an ice bath to further increase the pressure difference once some refrigerant has entered the tank. The experimental set up and illustration is as shown in FIG. 2. After pulses, the hand valve on the tank will be closed and the tank will be taken for weight measurement to find out the amount of refrigerant pulsed by weight. Then the tank will be evacuated again for next set of experiment. For a single pulse, some of the refrigerant will be lost, filling up the evacuated lines connecting the device. For two consecutive pulses, the second pulse should not have this problem and all the refrigerant should charge into the tank. By finding the difference between the first and second pulse, the accurate amount of refrigerant charged for each pulse can be determined and the amount loss through the lines can be determined as well. This experiment can further validate the volume calibration as well as account for the vapor weight loss in the lines in the actual experiment. The length of connection in this experiment will be similar to that of used in the actual device. The accurate amount of refrigerant pre-pulse can be determined.

On the software side of the device, apart from the controlling of solenoids, an algorithm has to be implemented to automatically determine whether the amount of refrigerant in the system is at an optimal level. The software then has to measure the performance of the refrigerator throughout testing. The performance indicators used in this approach is power consumption. While other indicators can be used according to the goal of the testing, power consumption will determine most directly the system's efficiency while the refrigerator is at the desired set point cabinet temperature.

System's performance data should be collected and compared only with it being at steady state at the desired set point. This way the cooling capacity will remain constant while comparing the power consumption at different charge levels. In this project, the steady state is determined with power consumption as well. A moving window of 10 minutes of power consumption data is collected. The difference between the max and min of the array as well as its standard deviation by the mean are calculated at each second and is compared to a threshold. Only when both indicators are within the threshold, the software will decide it is at steady state.

Figure 3:
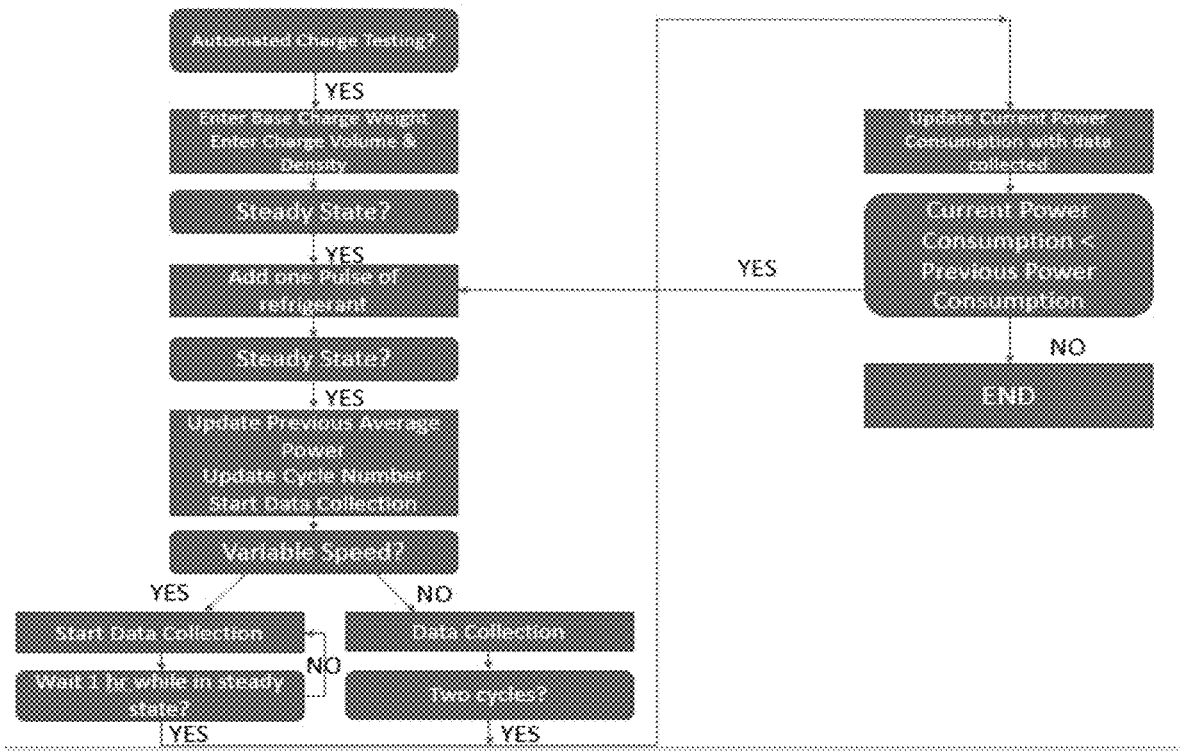
FIG. 3 illustrates an automatic charge testing software flowchart.

The performance of the system is expected to improve as the refrigerant charge increase from being low on charge towards the optimal charge. Once the refrigerant charge is at the optimal level and more refrigerant is charged into the system, the performance of the unit is expected to decrease. Using this logic, the software will compare the performance indictor after each pulse of refrigerant with that of the previous charge level. If the performance of the system is still increasing, then the optimal charge has not been reached. However, if the performance start to decrease, then the optimal charge is reached and charge testing can stop. This is shown in the flow chart in FIG. 3.

RESULTS AND DISCUSSION

First part of project aims to prove the validity of the concept on a R134a commercial refrigerator. Before using the device to charge the unit and carry out automatic charge testing, the experiment calibrating the weight of refrigerant per pulse mentioned in the previous section is performed. The experimental results are shown in FIG. 4.

As shown in FIG. 4, three sets of experiments are done. For each set of experiment, the device pulsed one, two and three pulses into the evacuated tank separately and measured the weight of the tank after the pulses. From the results, the first pulse is around 4.23 grams of refrigerant while the second and third pulses are both 4.50 grams. This shows the lines before the connecting the device and the unit holds around 0.27 grams of refrigerant in vapor. Further, this experiment shows that the device is charging 4.50 grams of R134a per pulse. This data is used in the automatic charge testing later.

During the development of the device, the accurate determination of the charging volume proves to be quite difficult. Since the charging volume is only around 2 cc, typical method of using water or other substances to find the volume is not available. The surface tension of the liquid holds it in the volume and the weight of the liquid itself is not enough to overcome it. Therefore for the R134a concept validation, the aforementioned charge per pulse data is used to perform the automatic charge testing later on.

Figure 5:
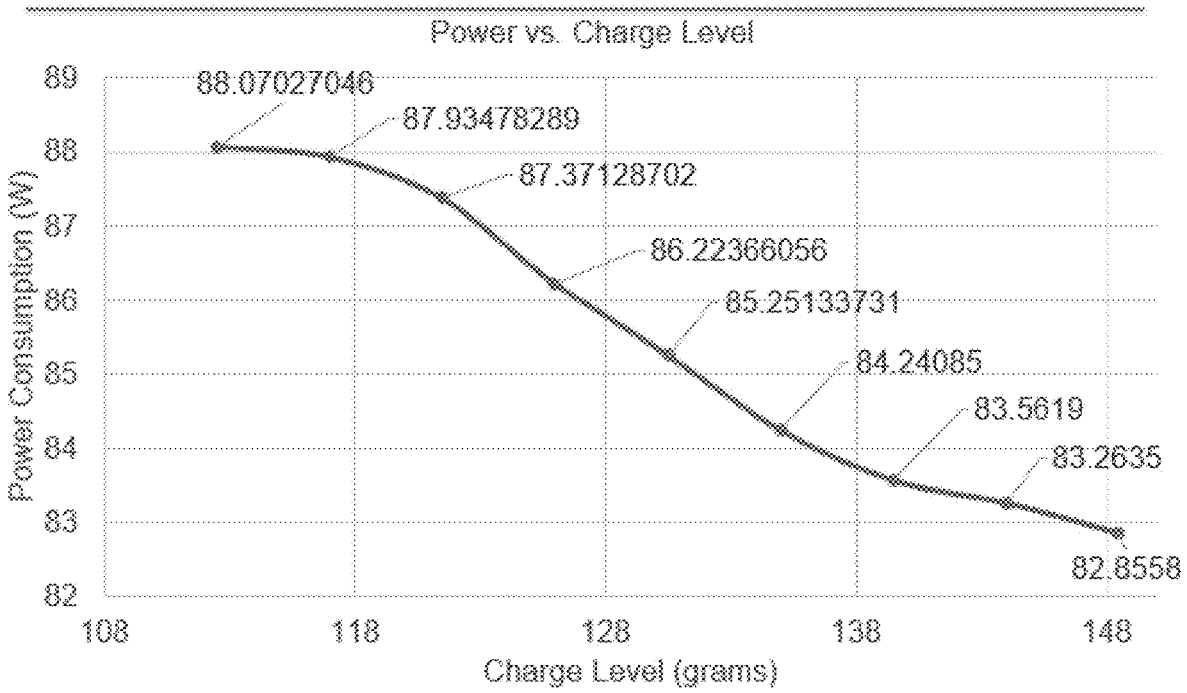
FIG. 5 illustrates example charge vs. power consumption curve from R134a unit testing.

FIG. 5 shows the plot of refrigerant charge level vs. power consumption curve. The unit for this testing is a whirlpool commercial R134a refrigerator with a variable speed compressor. The nominal charge for the refrigerator is 5.5 oz, which is 155 grams. The plot shows the expected trend of increasing system performance as the refrigerant charge level approaches nominal charge. As the cabinet temperature is remained constant at each charge level, the power consumption decreases. Each pulse adds 4.5 grams of refrigerant to the unit and the software collected the steady state data at each charge level. From the data collected, the software will decide whether system is at optimal charge to end the experiment or not.

For the experiment that generated this data, it was not able to complete until the optimal point has been clearly included in the curve. Experiment had to end due to the amount of time consumed for the person monitoring. The device is designed to be operated without human supervision. Since it is the first time testing the device and the software, supervision is required to ensure safety.

Those skilled in the art will recognize that numerous modifications can be made to the specific implementations described above. The implementations should not be limited to the particular limitations described. Other implementations may be possible.

We claim:

1. An apparatus suitable for providing an optimized amount of refrigerant to a refrigeration system, comprising:

a first valve with a first inlet and a first outlet;

a second valve with a second inlet and a second outlet;

a third valve with a third inlet and a third outlet; and a fluid coupling with a first opening, a second opening and a third opening;

wherein:

the first inlet of the first valve is configured to connect to the first opening of the fluid coupling, the first outlet of the first valve is configured to connect to a refrigerant source through a first fluid line that is attached to a vapor inlet of the refrigerant source, the second inlet of the second valve is configured to connect to the refrigerant source through a second fluid line to receive a liquid refrigerant released from a liquid outlet of the refrigerant source, the second outlet of the second valve is configured to connect to the second opening of the fluid coupling, the third inlet of the third valve is configured to connect to the third opening of the fluid coupling through a third fluid line, the third outlet of the third solenoid valve is configured to connect to a refrigeration system to be charged with optimal amount of refrigerant, and a cavity within the fluid coupling is configured to be a refrigerant calibrating chamber operable to store a volume of refrigerant, wherein in a first configuration for filling the refrigerant calibrating chamber with the volume of refrigerant, the first and second valves are configured to hold open while the third valve is configured to hold closed, and in a second configuration for delivering the volume of refrigerant to the refrigeration system, the first and second valves are configured to hold closed while the third valve is configured to hold open.

2. The apparatus of claim 1, wherein the cavity within the fluid coupling has a volume of 0.5 mL to 5 mL.

3. The apparatus of claim 1, wherein the fluid coupling has a coated internal surface to mitigate trapping of the refrigerant within the fluid coupling.

4. An apparatus suitable for providing an optimized amount of refrigerant to a refrigeration system, comprising:

a refrigerant storage volume having a first port and a second port, wherein the first port includes a liquid refrigerant outlet and the second port includes a vapor refrigerant inlet;

a first valve with a first inlet and a first outlet;

a second valve with a second inlet and a second outlet;

a third valve with a third inlet and a third outlet; and a three-way fluid coupling with a first opening, a second opening and a third opening;

wherein:

the first inlet of the first valve is configured to connect to the first opening of the three-way fluid coupling, the first outlet of the first valve is configured to connect to the refrigerant storage volume through a first fluid line that is attached to the vapor refrigerant inlet of the refrigerant storage volume, the second inlet of the second valve is configured to connect to the refrigerant storage volume through a second fluid line to receive a liquid refrigerant released from the liquid refrigerant outlet of the refrigerant storage volume, the second outlet of the second valve is configured to connect to the second opening of the three-way fluid coupling, the third inlet of the third valve is configured to connect to the third opening of three-way fluid coupling, the third outlet of the third valve is configured to connect to a refrigeration system to be charged with optimal amount of refrigerant, and a cavity within the three-way fluid coupling operable as a refrigerant calibrating chamber.

5. A method of providing a refrigerant from a refrigerant source to a refrigeration system from an apparatus, wherein the apparatus includes a first valve, a second, valve, and a third valve each coupled with a fluid coupling, wherein the first valve is configured to fluidly couple between the fluid coupling and an inlet of the refrigerant source, the second valve is configured to fluidly couple between the fluid coupling and an outlet of the refrigerant source, and the third valve is configured to fluidly couple between the fluid coupling and the refrigeration system, wherein the fluid coupling defines a chamber therein, the method comprising:

a) opening the first valve and the second valve;

b) closing the third valve;

c) introducing a liquid portion of the refrigerant through the second valve into the chamber, and allowing a vapor portion of the refrigerant to be released from the chamber through the first valve until the chamber is filled with the liquid portion of the refrigerant;

d) closing the first valve and the second valve; and e) opening the third valve and allowing the liquid portion of the refrigerant in the chamber to move into the refrigeration system.

6. The method of claim 5, wherein an algorithm is implemented to automatically determine whether the amount of refrigerant in the refrigeration system is at a predetermined optimal level.

7. The apparatus of claim 1, wherein the first valve, second valve, and third valve are each solenoid valves.

8. The apparatus of claim 4, wherein the cavity within the three-way fluid coupling has a volume of 0.5 mL to 5 mL.

9. The apparatus of claim 5, wherein the three-way-fluid coupling has a coated internal surface to mitigate trapping of the refrigerant within the three-way fluid coupling.

10. The method of claim 5, wherein upon allowing the liquid portion of the refrigerant in the chamber to move into the refrigeration system, the liquid portion of the refrigerant is replaced with a vapor refrigerant from the refrigeration system.

11. The method of claim 5, further comprising repeating steps (a) through (e) until a predefined optimal amount of refrigerant is achieved within the refrigeration system.

* * * * *